US005603789A

United States Patent [19]

Whitmyer

[11] Patent Number: 5,603,789

[45] Date of Patent: Feb. 18, 1997

[54] LAST LITE RETAINER AND WEATHER SEAL FOR STRUCTURALLY BONDED GLAZING

[75] Inventor: Wayne E. Whitmyer, Lilburn, Ga.

[73] Assignee: Kawneer Company, Inc., Norcross, Ga.

[21] Appl. No.: 538,841

[22] Filed: Oct. 4, 1995

Related U.S. Application Data

[63] Continuation of Ser. No. 350,732, Dec. 7, 1994, abandoned, which is a continuation of Ser. No. 71,771, Jun. 4, 1993, abandoned, which is a division of Ser. No. 730,543, Jul. 16, 1991, abandoned.

[51] Int. Cl.[6] ..... E04B 2/96; E06B 3/64

[52] U.S. Cl. ..... 156/108; 52/235; 52/745.16; 52/775; 156/71

[58] Field of Search ..... 156/71, 108; 52/208, 52/235, 204.591, 204.593, 204.597, 745.15, 745.16, 781.3, 764, 775

[56] References Cited

U.S. PATENT DOCUMENTS

| | | | |
|---|---|---|---|
| 3,435,579 | 4/1969 | Horgan, Jr. | 52/235 |
| 3,527,010 | 9/1970 | Brzezinski | 52/397 |
| 3,579,939 | 5/1971 | Eichman | 52/235 X |
| 3,719,014 | 3/1973 | Sukolics | 52/235 |
| 3,736,717 | 6/1973 | Farley | 52/235 X |
| 3,978,629 | 9/1976 | Echols, Sr. | 52/235 |
| 4,008,552 | 2/1977 | Biebuyck | 52/403 X |
| 4,377,926 | 3/1983 | Coulston et al. | 52/309.3 |
| 4,464,874 | 8/1984 | Shea, Jr. et al. | 52/398 |
| 4,608,793 | 9/1986 | Yost et al. | 52/235 |
| 4,638,613 | 1/1987 | Tönsmann | 52/235 |
| 4,650,702 | 3/1987 | Whitmyer | 428/31 |
| 5,245,808 | 9/1993 | Grunewald et al. | 52/397 X |

*Primary Examiner*—Michael W. Ball
*Assistant Examiner*—Francis J. Lorin

[57] ABSTRACT

A method and apparatus are disclosed for glazing a last lite into a window opening between two previously installed lites. Retainers are installed onto the adjacent vertical edges of the two previously installed lites. The retainers are configured such that the last lite can be pivoted into position against a transverse flange of the retainer without obstruction. Subsequent to the last lite being set, frame members are engaged with the retainers, thereby capturing the edges of the last lite between the retainers and the corresponding frame members. The last lite is then structurally bonded to the frame members. The entire last lite glazing sequence can be accomplished quickly and easily from inside the building.

10 Claims, 6 Drawing Sheets

LAST LITE RETAINER AND WEATHER SEAL FOR STRUCTURALLY BONDED GLAZING

This is a continuation of U.S. patent application Ser. No. 08/350,732, filed Dec. 7, 1994, now abandoned which is a continuation of U.S. patent application Ser. No. 08/071,771, filed Jun. 4, 1993, now abandoned which is a division of U.S. patent application Ser. No. 07/730,543, filed Jul. 16, 1991 now abandoned.

TECHNICAL FIELD

The present invention relates generally to methods and apparatus for glazing windows and relates more specifically to a method and apparatus for glazing the last-installed lite in a series or "ribbon" of windows.

BACKGROUND OF THE INVENTION

Curtain wall assemblies comprising a series or ribbon of windows are well known. Typically, a series of frame members is erected to form a plurality of rectangular window openings. Window panes, or "lites," are then mounted to adjacent frame members over each of the window openings defined by the frame members. A retainer and weather seal, which may comprise different structures or a single unitary structure serving both functions, is used to affix the edges of the lite to the corresponding frame members. In a conventional glazing system, a retainer is attached to a first frame member. One edge of the lite is engaged with the retainer, and the opposite edge of the lite is brought into position against the second frame member. By reaching around the second frame member through the adjacent window opening, the installer then installs a second retainer onto the second frame member to secure and seal the second edge of the lite. The first edge of the next lite is then secured to the opposite side of the second retainer, and the windows are set in series.

In each ribbon of windows, there is one lite which is the last to be set. Unique problems are associated with the setting of the last lite. For example, the setting of other lites is somewhat simplified by the presence of the unoccupied window opening adjacent at least one side of the lite. The installer can reach through the unoccupied opening from within the building to perform those glazing steps which require access to the exterior side of the lite. However, the last lite is set in an opening which is enclosed on both sides by previously installed lites. Thus, certain glazing steps which are normally accomplished from the inside of the building by reaching through the adjoining window opening cannot be performed in this manner with respect to the last lite. Steps which require access to the exterior surface of the lite therefore require that certain aspects of the glazing procedure for the last lite be performed from outside the building. As will be appreciated, this requirement greatly complicates the erection sequence when the curtain wall is being installed on the upper floors of a multistory building. For example, scaffolding may have to be erected on the exterior of the building to provide a work platform from which to perform these exterior glazing steps.

Similar problems arise in the context of reglazing a lite. Irrespective of whether the replaced lite was originally the last lite glazed, the replacement lite is now being installed into an opening wherein both of the adjoining window openings are already glazed. Since access through the adjacent window openings is precluded, installation steps which require access to the exterior surface of the window, such as installation of a gasket, retainer, or weather seal, cannot be performed from inside the building. Replacing a lite on an upper floor of a multistory building is again greatly complicated and may require the erection of scaffolding or the like to replace the lite.

As used herein, the term "last lite" shall be understood to refer not only to the last lite to be set during the initial installation of a ribbon of windows but also to any lite which must be glazed when lites are already set in both of the adjoining window openings. Accordingly, a lite which is being replaced or reglazed when both adjoining window openings are already occupied by lites shall be understood to fall within the meaning of the term "last lite" as that term is used herein.

As will be appreciated, there is a need for a window glazing system which will facilitate installation of the last lite.

There is a further need for a window glazing system which will permit the last lite to be glazed entirely from within the interior of a building.

SUMMARY OF THE INVENTION

As will be seen, the present invention overcomes these and other problems associated with prior art retainers and weather seals for glazing last lites. Stated generally, the present invention comprises an apparatus for glazing a last lite into a window opening between two previously installed lites. A retainer includes a transverse flange disposed at the front end of a stem. The retainer further includes an attachment means disposed at the back end of said stem and lying only on one side of said stem. In the disclosed embodiment, the attachment means is a hook member. The retainer further includes a channel defined on one side of the stem between the attachment means and the transverse flange. A frame member has a mating means for engaging the attachment means of the retainer to secure the frame member to the retainer. In the disclosed embodiment, the mating means is a flange which engages the retainer's hook element.

The retainer is attached to an adjacent vertical edge of one of said previously installed lites by inserting the channel of the retainer over the adjacent vertical edge of the previously installed lite. When installed in this manner, the attachment means, such as the hook elements of the disclosed embodiment, are disposed outwardly of the last lite opening. Thus, a last lite can be set into the head and pivoted into position against the transverse flange of the retainers without obstruction. After the last lite is set into position, the frame member is attached to the retainer, thereby capturing the last lite between the retainer and the face of the frame member. In the disclosed embodiment, spacer members are subsequently inserted between the last lite and the frame member to position the last lite in spaced apart relation to the face of the frame member. A silicone bead is then packed into the gap between the last lite and the frame member to structurally bond the last lite to the frame member.

The invention also comprises a method for glazing a last lite into a window opening between two previously installed lites. First, a retainer is installed onto the adjacent vertical edge of at least one of the two previously installed lites. The last lite is then set into position such that a vertical periphery of said exterior face of said last lite is disposed against said retainer. After the last lite has been set into position, a vertical frame member is mounted to the retainer so as to capture a vertical edge of the last lite between the retainer and the face of the vertical frame member. In a preferred method, spacer elements are then installed between the last lite and the frame member to provide a gap between the last lite and the frame member. A silicone bead is then packed into the gap to structurally bond the last lite to the frame member.

Using the method and apparatus of the present invention, a last lite can be set into a window opening between two previously installed lites entirely from the interior of the building, thereby eliminating the need for exterior glazing steps. Thus, in the case of a multistory building, the need to erect scaffolding to provide a platform from which such exterior glazing steps can be accomplished is eliminated, thereby greatly simplifying the glazing process.

Thus, it is an object of the present invention to provide an improved retainer and weather seal for glazing a last lite.

It is another object of the present invention to provide an improved retainer and weather seal which permits a last lite to be glazed entirely from the inside of a building.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
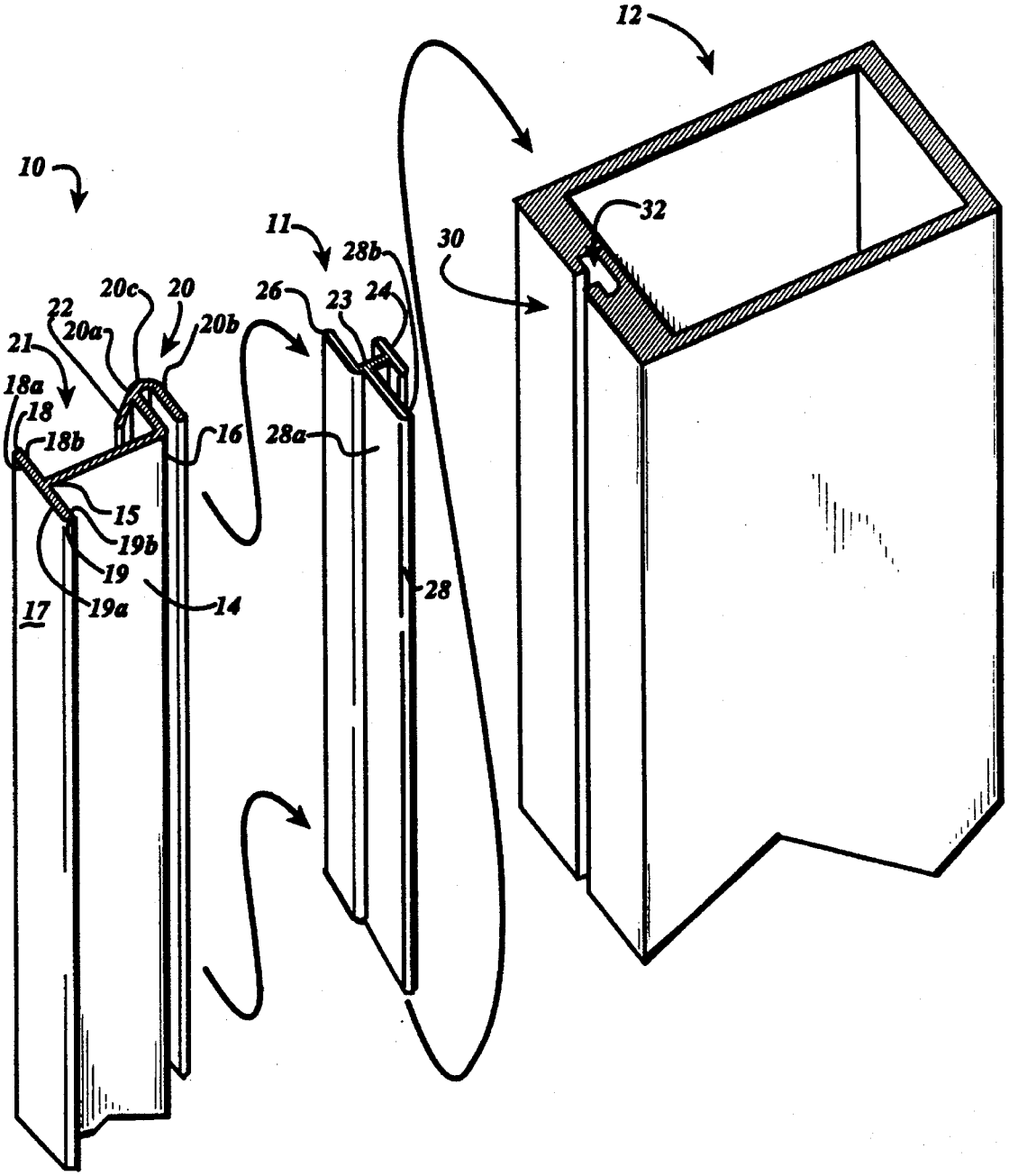
FIG. 1 is a perspective view of a retainer, a filler, and a vertical mullion which comprise the structurally bonded glazing system of the present invention.

Referring now to the drawings, in which like numerals indicate like elements throughout the several views, FIG. 1 shows a last lite retainer 10, a filler 11, and a vertical mullion 12 for glazing a last lite. The retainer 10 also serves as a weather seal and is formed as a plastic extrusion of CPVC or other suitable thermally insulating material. The CPVC material comprising the retainer 10 of the disclosed embodiment is coextruded with Duracap® polyvinyl capstock from The B. F. Goodrich Company, Akron, Ohio, which includes inhibitors which resist damage from ultraviolet rays. If desired, the retainer 10 may be formed of an appropriately colored plastic or can be painted for aesthetic purposes.

The retainer 10 includes a stem 14 having a forward edge 15 and a rear edge 16. A transverse flange 17 comprising a pair of opposing legs 18, 19 extends laterally from the forward edge 15 of the stem 14, forming a T-shape. The legs 18, 19 have outer surfaces 18*a*, 19*a* and inner surfaces 18*b*, 19*b* respectively. A U-shaped hook member 20 is located at the rear edge 16 of the stem 14 and is disposed on one side of the stem. The U-shaped hook member 20 has an front portion 20*a*, a back portion 20*b*, and a curved outer portion 20*c*. A glazing channel 21 is defined on the retainer 10 between the front portion 20*a* of the U-shaped hook member 20 and the mutually facing inner surface 18*b* of the corresponding leg 18. The retainer 10 further comprises a resilient finger 22 projecting from the hook member 20 at approximately the juncture between the front portion 20*a* and the curved outer portion 20*c*. The resilient finger 22 extends at an angle into the glazing channel 21, for the purpose to be hereinbelow described.

The filler 11 has a short body portion 23. A T-shaped head 24 is formed at the rear edge of the body 23. A first flange 26 is located at the forward edge of the body 23 and extends laterally on one side thereof. The first flange 26 is configured to interlock with the U-shaped hook member 20 of the retainer 10 to engage the retainer and the filler 11. A second laterally extending flange 28 is located on the opposite side of the body 23 at an intermediate point thereon. The second flange 28 has an outwardly facing surface 28*a* and an inwardly facing surface 28*b*.

The vertical mullion 12 has a front face 30 and a T-shaped channel 32 formed in the front face 30. The channel 32 is configured to receive the T-shaped head 24 of the filler 11 and is dimensioned such that when the T-shaped head of the filler is received within the channel 32, the inwardly facing surface 28*b* of the second flange 28 of the filler bears against the front face 30 of the mullion 12.

Figure 2:
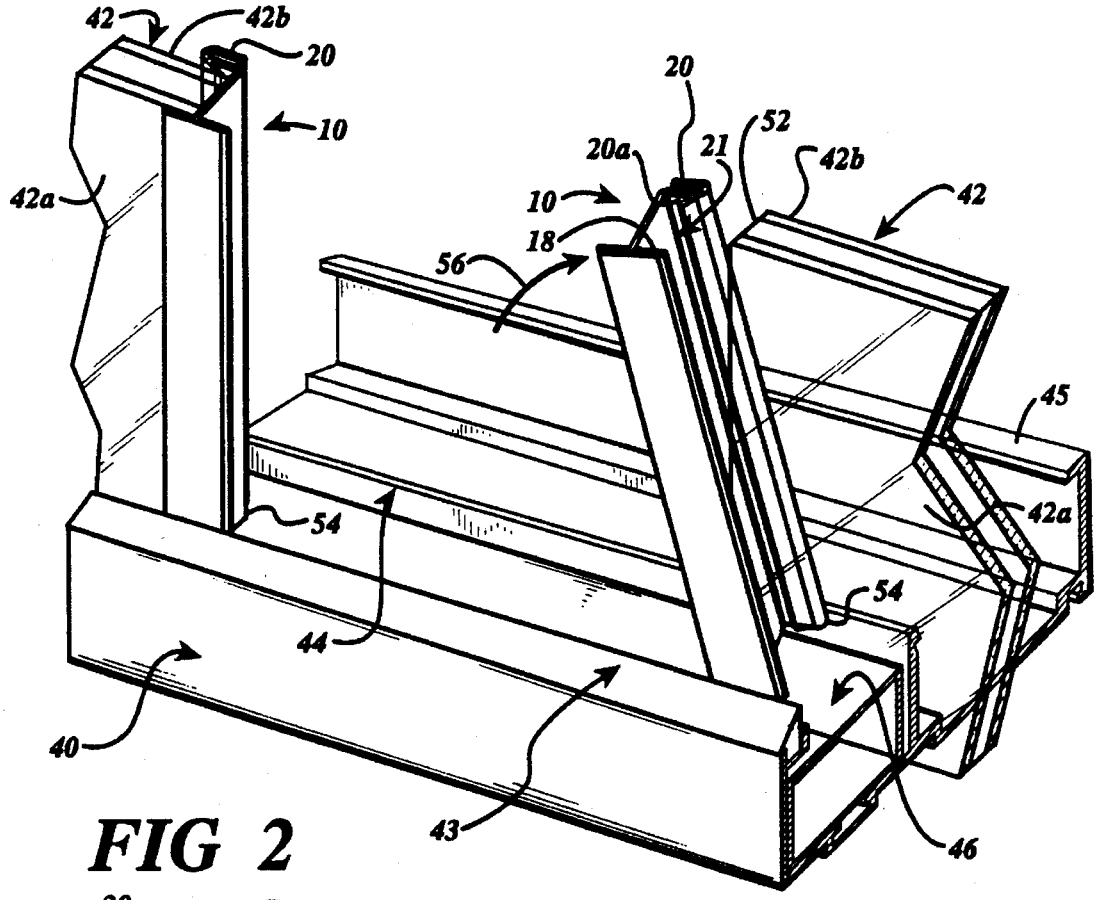
FIGS. 2–6 are perspective views showing the installation sequence of a last lite using the retainer, filler, and vertical mullion of FIG. 1.

FIGS. 2–6 illustrate the assembly sequence for installing a last lite using the glazing system of the present invention. FIG. 2 shows a sill receptor 40 into which lites 42 have already been glazed in the adjacent window openings prior to the erection of the last lite. Each lite 42 has an exterior surface 42*a* and an interior surface 42*b*. A last lite window opening 44 is defined between the adjoining lites 42. Interior aluminum finish inserts 45 have also already been installed onto the sill receptor 40 on the interior side of the installed lites 42. Also, a setting block 46 has already been positioned within the forward portion of the sill receptor 40 to support the lites. Finally, exterior weatherstripping 48 of conventional design has been installed along the forward edge of the sill receptor 40 between the sill and the lites 42. While the figures show only the sill receptor 40 and related glazing components, it will be understood that the upper edges of the lites 42 are similarly installed in a corresponding head receptor (not shown).

The first step in the erection of the last lite is that retainers 10 are installed onto the vertical edges 52 of the adjoining lites 42 adjacent the last lite opening 44. The lower end 54 of each retainer 10 is first tilted into the sill receptor 40 such that sufficient clearance is provided for the upper end of the retainer to pivot into the head receptor (not shown) in the direction indicated by the arrow 56. The glazing channel 21 of the retainer 10 is then aligned with the vertical edge 52 of the corresponding lite 42, and the retainer is then slid onto the lite, the edge of the lite being snugly received within the glazing channel. The resilient finger 22 bears against the interior surface 42*b* of the lite 42, effecting a snug fit of the edge 52 of the lite 42 within the channel 21 and ensuring intimate contact between the exterior surface 42*a* of the lite and the inner surface 18*b* of the leg 18. The angle of the finger 22 with respect to the direction of insertion of the edge 52 of the lite 42 into the channel 21 of the retainer 10 permits the retainer to be easily installed onto the edge of the lite but resists removal of the retainer from the lite once installed. Further, the finger 22 acts as an additional weather seal element. When installed onto the lites 42 in this manner, the U-shaped hook member 20 of each retainer 10 extends outwardly and away from the last lite window opening 44.

Figure 3:
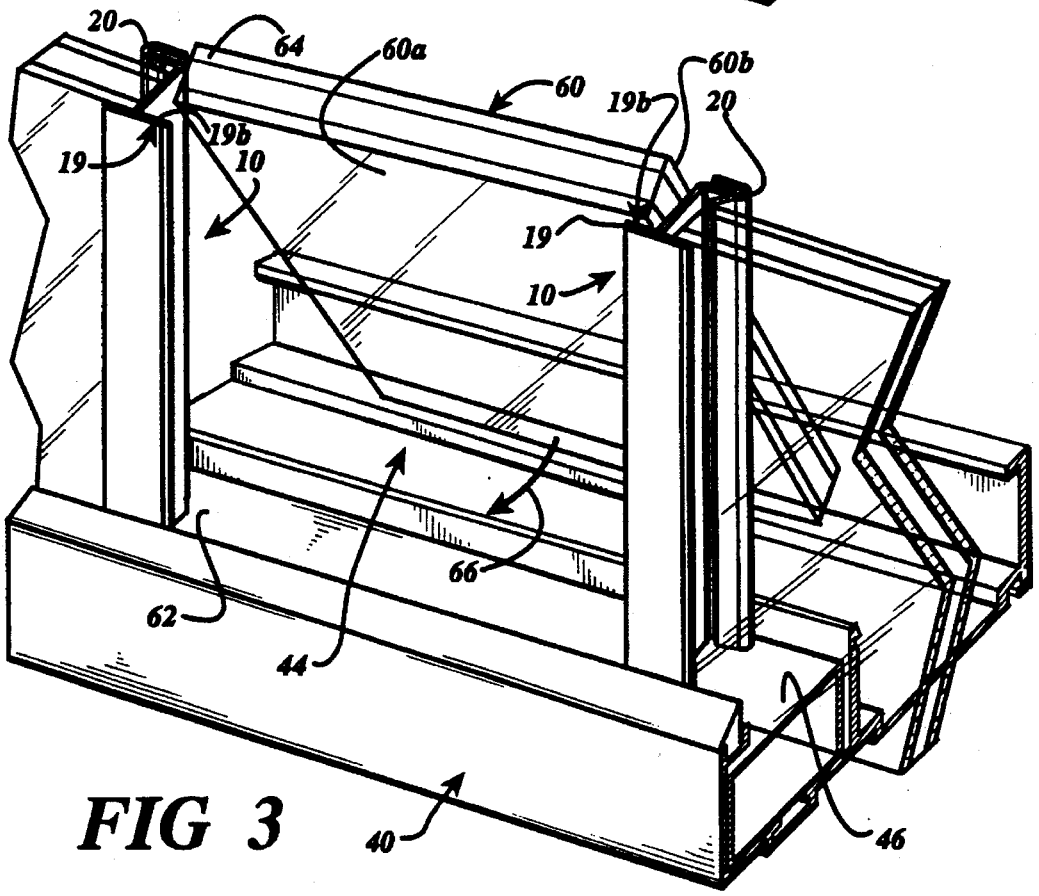

Referring now to FIG. 3, the procedure for setting a last lite 60 into place in the last lite opening 44 is illustrated. The last lite 60 includes an exterior face 60*a* and an interior face 60*b*. The upper edge 64 of the last lite 60 is tilted into the head receptor (not shown). The lower edge 62 of the last lite 60 is then swung forward in the direction indicated by the arrow 66 and into the sill receptor 40 and set on the setting block 46. It is important to note that since the U-shaped hook members 20 of the retainers 10 are disposed on the opposite side of the stem 14 from the last lite opening 44, the last lite 60 can pivot unobstructed into a position such that the vertical peripheries of the exterior face **60*b* of the last lite engage the inner surfaces 19*b* of the corresponding legs 19 of the retainers 10**.

Figure 4:
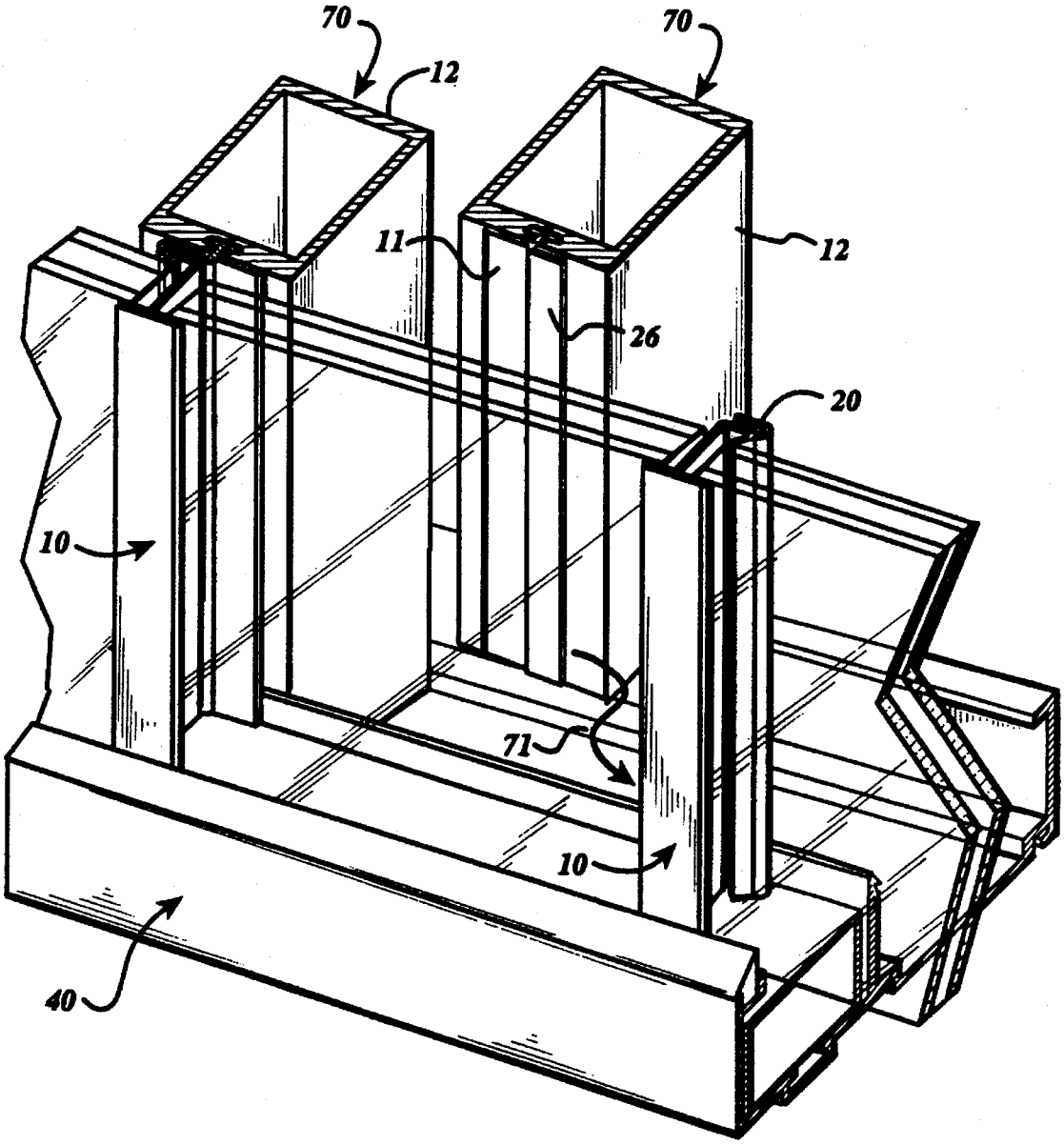

FIG. 4 shows the mounting of the vertical mullions 12 onto the retainer 10. A filler 11 is first mounted to each mullion 12 to form a mullion/filler assembly 70 by sliding the T-shaped head 24 of the filler longitudinally into the corresponding T-shaped channel 32 in the front face 30 of the mullion (see FIG. 1 ). The lower end of the mullion/filler assembly 70 is then tilted into the sill receptor 40, and the upper end of the assembly is tucked into the head receptor (not shown). The flange 26 of the filler 11 is then aligned with the U-shaped hook 20 of the corresponding retainer 10, and the mullion/filler assembly 70 is then slid onto the retainer in the direction indicated by the arrow 71, the flange 26 interlocking with the hook 20 to secure the mullion/filler assembly 70 to the retainer 10.

Figure 5:
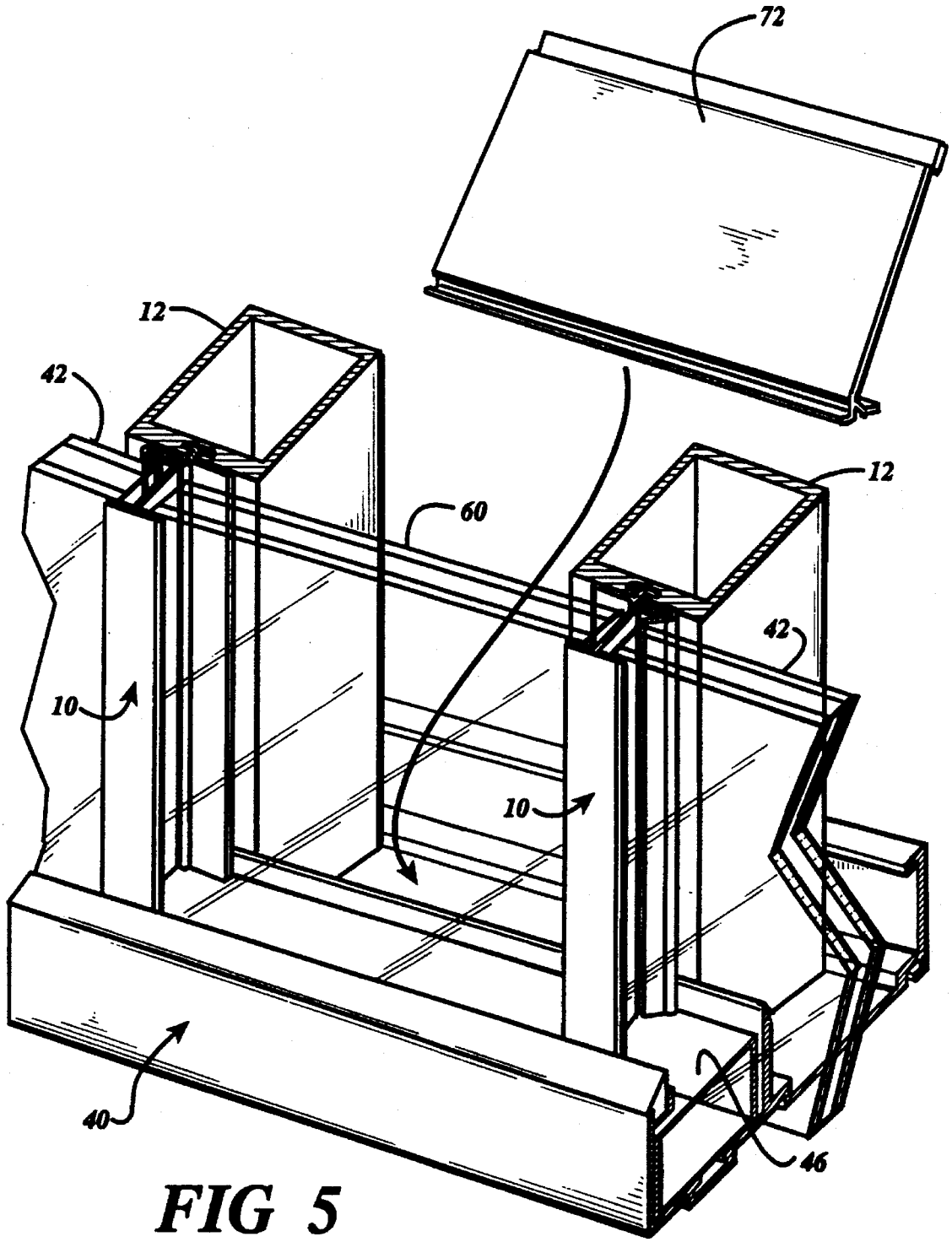
Figure 6:
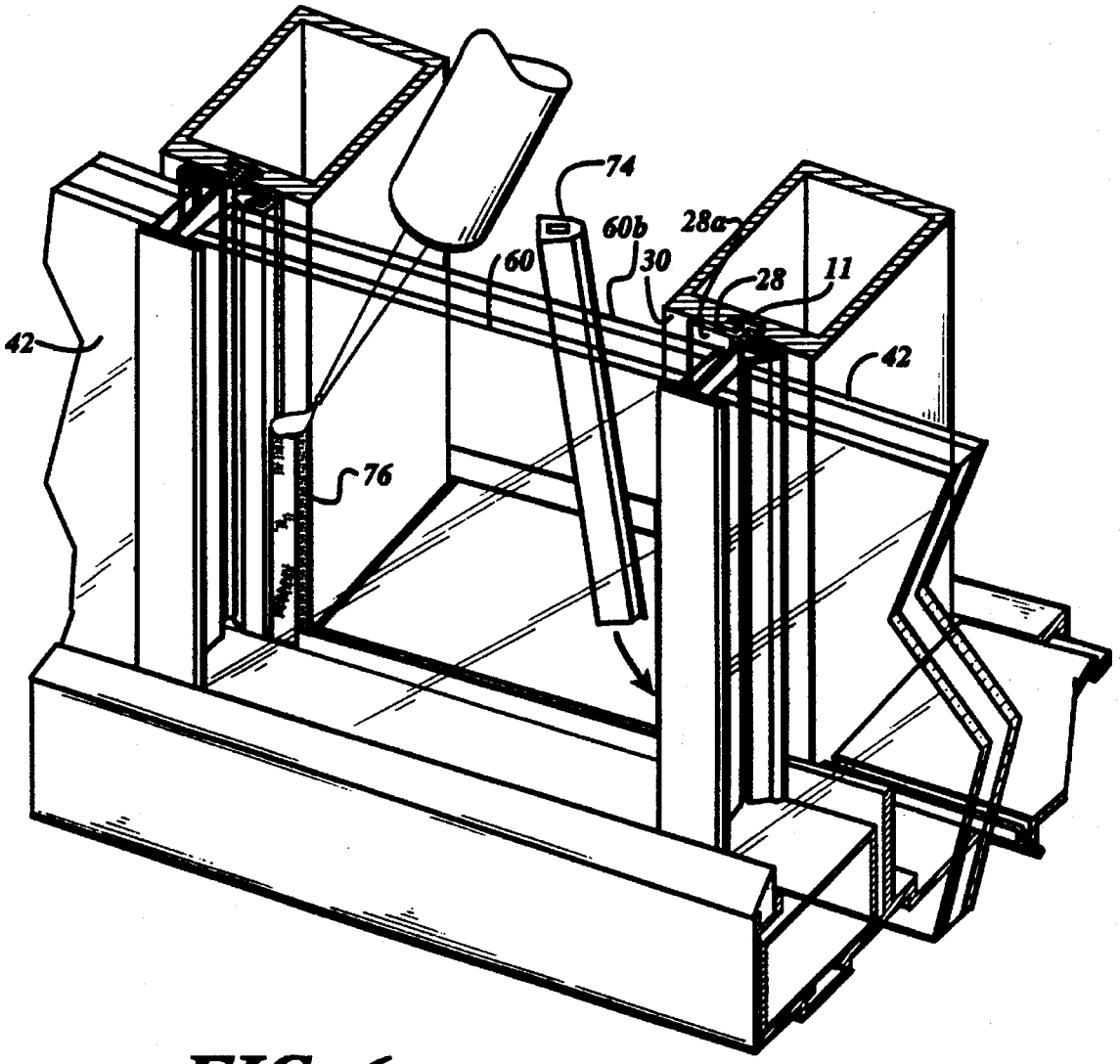
Figure 7:
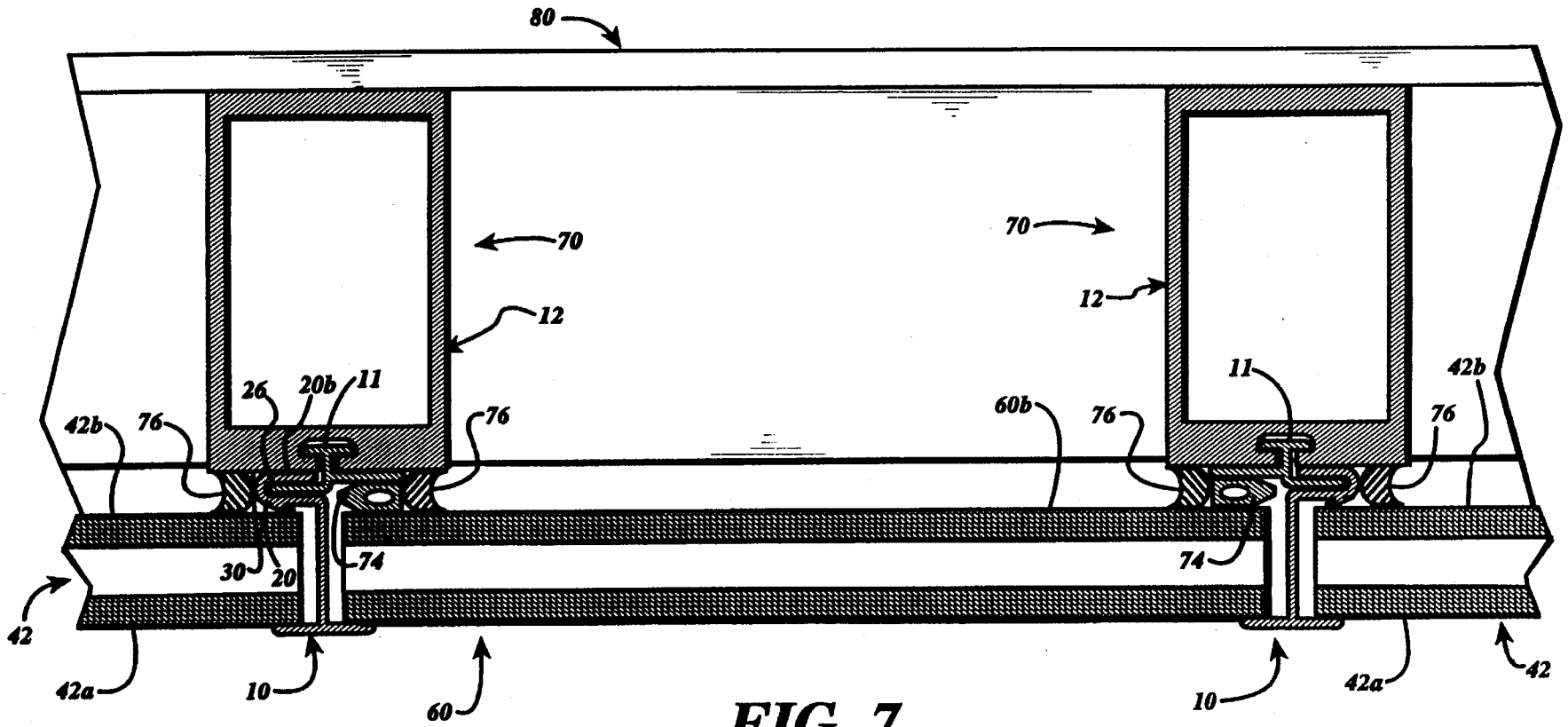
FIG. 7 is a top view of a completed last lite installation erected according to FIGS. 2–6.

With the last lite 60 and vertical mullions 12 installed as shown in FIG. 5, an interior insert 72 of conventional design is attached to the sill receptor 40 between the vertical mullions to conceal the opening in the sill receptor. A corresponding interior insert is similarly attached to the head receptor. Then, as shown in FIG. 6, wedge-shaped spacers 74 are inserted into the spaces between the interior face **60*b* of the last lite 60 and the outwardly facing surface 28*a* of the second flange 28 of each filler 11. The purpose of the spacers 74 is to space the interior face 60*b* of the last lite 60 a predetermined distance, preferably at least one quarter inch, from the front face 30 of the vertical mullion 12. In the disclosed embodiment, the predetermined distance between the interior face 60*b* of the last lite 60 and the front face 30 of the vertical mullion 12 is 0.35 inches. When the spacers 74 have been positioned, a silicone bead 76 is packed into the gap between the lateral edges of the interior face 60*b* of the last lite 60 and the front face 30 of the vertical mullion 12. As can be seen in FIG. 7, another silicone bead 76 is poured into the space between the lateral edges of the interior face 42*b* of each adjacent lite 42 and the front face 30 of the vertical mullion 12. When the silicone beads 76 have cured, the last lite 60 and each adjacent lite 42 are structurally bonded to the front face 30 of each of the vertical mullions 12**.

FIG. 7 is a top view of a completed last lite installation 80. It can be seen that with the retainer 10 installed onto the mullion/filler assembly 70, the back portion **20*b* of each U-shaped hook member 20 bears against the front face 30 of the corresponding mullion 12. It will be appreciated that the U-shaped hook members 20 of the retainers 10 thus serve a dual function: in addition to interlocking with the corresponding flange 26 of the filler 11 to secure the filler 11 to the retainer 10, the hook members 20 space the front face 30 of the corresponding mullion 12 by a predetermined distance from the interior faces 42*b* of the adjacent lites 42. The desired spacing is determined by the distance between the front portion 20*a* and the back portion 20*b* of the U-shaped hook member 20 and is preferably at least one-quarter inch. In the preferred embodiment, the distance between the front portion 20*a* and the back portion 20*b* of the U-shaped hook member 20 is approximately 0.35 inches, thereby producing a correspondingly sized gap between the interior face 42*b* of the adjacent lite 42 and the front face 30 of the vertical mullion 12. It will be noted that this gap corresponds to the dimension of the gap created by the spacer 74 on the opposite side of the retainer 10. Thus, the hook member 20 of the retainer 10 spaces the lites 42 from the front face 30 of the mullions 32 in essentially the same manner as the spacers 74 space the last lite 60 from the front face of the mullion, thereby to create a gap into which a silicone bead 76** can be packed.

Referring further to FIG. 7, it can be seen that the back portion **20*b* of the hook member 20 of the retainer 10 bears against the front face 30 of the mullion 12. For the second laterally extending flange 28 of the filler 11 to bear against the front face 30 of the mullion 12, the second flange 28 of the filler 11 must be offset rearward from the first flange 26 by a distance equal to the thickness of the hook member 20 of the retainer 10. The second flange 28 thus bears flush against the front face 30 of the mullion 12 to stabilize the filler 11**.

As can also be seen in FIG. 7, the retainer 10 also serves as a weather seal in the completed installation, covering and sealing the gap between adjacent lites. Further, the lites 42, 60 are thermally insulated from the vertical mullions 12 by the structural silicone beads 76, the spacers 74, and the U-shaped hook members 20 of the retainers 10. Thus, there is no thermal path between the exterior and the interior of the building by which heat can be conducted.

As will be appreciated by those skilled in the art, conventional structural silicone glazing procedures call for the vertical frame members to be erected prior to the lites being set. An important feature of the glazing procedure of the present invention is that the retainer 10 and the last lite 60 are positioned within the sill and head before the vertical mullions 12 are installed. In this manner, all of the glazing steps, including installation of the weather seal and setting of the last lite, can be performed from inside the building.

The retainer 10 of the disclosed embodiment is configured to accommodate one inch dual glazed infill panels. However, it will be appreciated that narrower or wider infill panels can be accommodated simply by providing retainers with shorter or longer stems.

It will further be appreciated that the exact cross-sectional configuration of the vertical mullion 12 is of no particular significance, and that any mullion configuration can be employed as long as there is an appropriate front face to which the lites can be structurally bonded and some appropriate means by which a filler can be mounted to the mullion.

While the invention has been disclosed with respect to an embodiment wherein a separate filler 11 and mullion 12 are slidably interlocked, it is possible to provide a mullion with an integral flange for engaging the hook member 20 of the retainer 10, thereby eliminating the need for a separate filler 11. It will therefore be understood that when reference is made generally to securing the retainer 10 to a vertical frame member, the securing attachment may be made by way of the filler or by attaching the retainer directly to the mullion.

Finally, it will be understood that the preferred embodiment has been disclosed by way of example, and that other modifications may occur to those skilled in the art without departing from the scope and spirit of the appended claims.

What is claimed is:

1. A method for glazing a last lite having interior and exterior faces into a window opening between two previously installed lites, comprising the steps of:

installing a retainer onto the adjacent vertical edge of at least one of said two previously installed lites;

setting said last lite such that a vertical periphery of said exterior face of said last lite is disposed against said retainer;

subsequent to said step of setting said last lite, mounting a vertical frame member having a face to said retainer so as to capture a vertical edge of said last lite between said retainer and said face of said vertical frame member; and structurally bonding said last lite and said adjacent lite to said face of said vertical frame member.

2. The method of claim 1, wherein said step of mounting a vertical frame member to said retainer comprises the steps of:

mounting a filler to said vertical frame member; and securing said filler to said retainer.

3. The method of claim 2, wherein said filler defines a longitudinal axis, and wherein said step of mounting a filler to a vertical frame member comprises the step of sliding the head of said filler in the direction of said longitudinal axis into a corresponding channel formed in a vertical frame member so as to secure said filler to said vertical frame member.

4. The method of claim 1, comprising the further step of inserting a spacer member between said interior face of said last lite and said face of said vertical frame member, thereby to provide a gap of predetermined dimension between said interior face of said last lite and said face of said vertical frame member for receiving a structural silicone bead therewithin.

5. The method of claim 4, comprising the further step of pouring a structural silicone bead into said gap to structurally bond said last lite to said face of said vertical frame member.

6. A method for glazing a last lite having interior and exterior faces into a window opening between two previously installed lites, comprising the steps of:

installing a retainer comprising a unitary structure having a channel defined therein onto the adjacent vertical edge of at least one of said two previously installed lites by inserting the vertical edge of said at least one of said two previously installed lites into said channel of said retainer;

setting said last lite such that a vertical periphery of said exterior face of said last lite is disposed against said retainer; and subsequent to said step of setting said last lite, mounting a vertical frame member having a face to said retainer so as to capture a vertical edge of said last lite between said retainer and said face of said vertical frame member.

7. The method of claim 6, wherein said step of mounting a vertical frame member to said retainer comprises the steps of:

mounting a filler to a vertical frame member; and securing said filler to said retainer.

8. The method of claim 7, wherein said step of mounting a filler to a vertical frame member comprises the step of sliding the head of a filler longitudinally into a corresponding channel formed in a vertical frame member so as to secure said filler to said vertical frame member.

9. The method of claim 6, comprising the further step of inserting a spacer member between said interior face of said last lite and said face of said vertical frame member, thereby to provide a gap of predetermined dimension between said interior face of said last lite and said face of said vertical frame member for receiving a structural silicone bead therewithin.

10. The method of claim 9, comprising the further step of pouring a structural silicone bead into said gap to structurally bond said last lite to said face of said vertical frame member.

* * * * *